United States Patent [19]

Yamakawa

[11] Patent Number: 4,512,301

[45] Date of Patent: Apr. 23, 1985

[54] INTERNAL COMBUSTION ENGINE PROVIDED WITH A PLURALITY OF POWER UNITS

[75] Inventor: Toru Yamakawa, Hachioji, Japan

[73] Assignee: Fuji Jukogyo Kabushiki Kaisha, Tokyo, Japan

[21] Appl. No.: 403,740

[22] PCT Filed: Nov. 30, 1981

[86] PCT No.: PCT/JP81/00360

§ 371 Date: Jul. 29, 1982

§ 102(e) Date: Jul. 29, 1982

[87] PCT Pub. No.: WO82/02226

PCT Pub. Date: Jul. 8, 1982

[30] Foreign Application Priority Data

Dec. 25, 1980 [JP] Japan ..... 55-184780

[51] Int. Cl.[3] ..... F02D 25/04; F02D 17/02

[52] U.S. Cl. ..... 123/198 F; 123/DIG. 8; 60/718

[58] Field of Search ..... 123/198 F, DIG. 8, 2; 60/716, 718, 719

[56] References Cited

U.S. PATENT DOCUMENTS

| | | | |
|---|---|---|---|
| 902,692 | 11/1908 | Sherman | 123/198 F |
| 1,306,864 | 6/1919 | Stoddard | 123/DIG. 8 |
| 1,309,279 | 7/1919 | Eggert et al. | 123/198 F |
| 1,900,470 | 3/1933 | Smith | 60/718 |
| 2,623,617 | 2/1952 | Snyder et al. | 123/198 F |
| 2,757,651 | 8/1956 | Winkler | 123/198 F |
| 3,949,556 | 4/1976 | Wallis | 60/718 |
| 4,027,484 | 6/1977 | Wallis | 60/718 |
| 4,027,485 | 6/1977 | Wallis | 60/718 |
| 4,069,803 | 1/1978 | Cataldo | 123/198 F |
| 4,337,623 | 7/1982 | Kronogard | 123/DIG. 8 |

*Primary Examiner*—Ira S. Lazarus

*Attorney, Agent, or Firm*—Martin A. Farber

[57] ABSTRACT

An internal combustion engine comprising a primary engine unit and an auxiliary engine unit, in which a clutch of the auxiliary engine unit is engaged at a proper time dependent on the acceleration of the primary engine unit.

15 Claims, 10 Drawing Figures

INTERNAL COMBUSTION ENGINE PROVIDED WITH A PLURALITY OF POWER UNITS

TECHNICAL FIELD

The present invention relates to an internal combustion engine provided with a plurality of independent engine units in which one or more engine units are selectively used in accordance with driving conditions of a vehicle driven by the engine.

BACKGROUND ART

It is preferable to design an engine for a constant load so that a desired torque can be generated at a low specific fuel consumption. However, it is difficult to design an engine for driving vehicles so as to have a low specific fuel consumption within the entire range of the engine operation, since load on the engine varies in a wide range.

FIG. 1 shows a fuel consumption characteristic of an engine for a vehicle at various specific fuel consumptions (g/ps.hr), in which the abscissa is engine speed (r.p.m.), and the ordinate is engine torque. Curve A shows the running load (resistance) of a vehicle on a flat road. The curve A is determined by the drag of the body of the vehicle and the gear ratio of the transmission of the engine and the specific fuel consumption is determined by the performance of the engine. It is desirable to design the engine so that the curve A passes through low fuel consumption zones.

DISCLOSURE OF THE INVENTION

The object of the present invention is to provide an engine assembly for a vehicle, which comprises a plurality of independent engine units, one or more of the engine units being selectively operated in accordance with conditions of the engine operation, whereby the engine assembly is operated in low fuel consumption zones within a wide range of the engine operation.

The engine assembly of the present invention comprises at least two engine units, one of which is a primary engine unit and the other is an auxiliary engine unit. In a low torque range, the primary engine unit is operated, and in a high torque range, the primary and auxiliary units are operated together to drive the vehicle in accordance with the driving conditions of the vehicle.

FIG. 2 shows a fuel consumption characteristic of an engine assembly according to the present invention comprising two engine units. A first zone C is characteristic of the primary engine unit and a second zone E is characteristic of the engine assembly in which the primary engine unit and auxiliary engine unit are combined. The fuel consumption characteristic of the second zone is the same as that of the conventional engine shown in FIG. 1 and the running load curve B is the same as the curve A. Since the curve B passes through a minimum fuel consumption zone D at a low torque operation as shown in FIG. 2, the fuel consumption is improved. The auxiliary engine unit is adapted to be started and connected to the output system of the primary engine unit, when the combined power is necessary to drive the vehicle. However, if the starting system for the auxiliary engine unit is so arranged that the engine is started at a time when the primary engine reaches the maximum torque operation, a difficulty arises in rapid acceleration of the vehicle. Namely, the engine torque must rapidly increase in order to accomplish a necessary rapid acceleration. However, the auxiliary engine inevitably delays starting and does not quickly reach a high torque operation sufficient for rapid acceleration. In order to eliminate such a drawback, if the starting timing is advanced so as to start the auxiliary engine at an earlier stage, the auxiliary engine is unnecessarily operated before a necessary common operation stage in a gradual acceleration. This will cause an increase of fuel consumption.

Therefore, the engine assembly of the present invention is provided with an acceleration detecting means and a control means for controlling the starting timing of the auxiliary engine unit in accordance with the detected acceleration condition in order to prevent the starting delay of the auxiliary engine unit, thereby to enable the engine assembly to operate reliably in cooperation.

With the above and other objects and advantages in view, the present invention will become more clearly understood in connection with the detailed description of a preferred embodiment, when considered with the accompanying drawings, as follows.

BEST MODE FOR EMBODYING THE INVENTION

Figure 1:
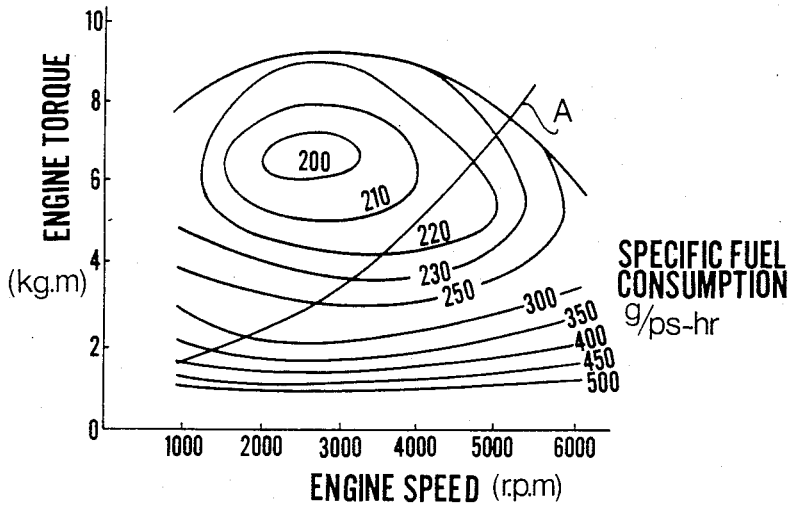
FIG. 1 is a graph showing a fuel consumption characteristic of a conventional engine.
Figure 2:
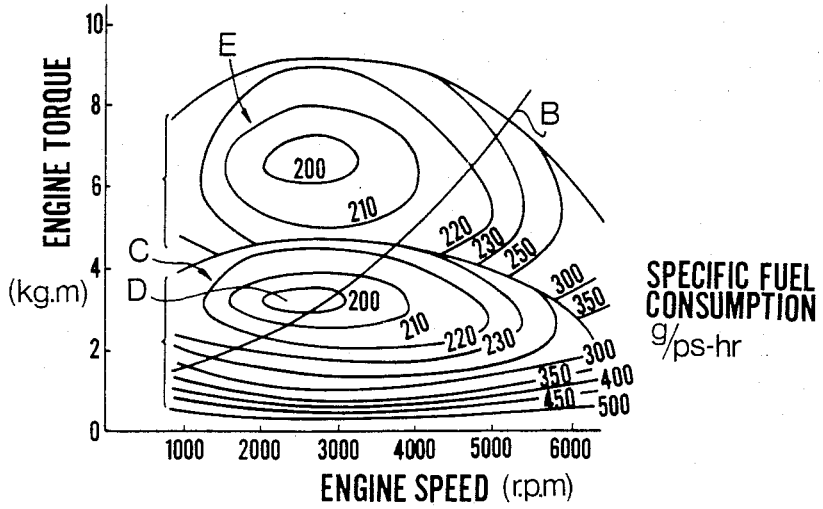
FIG. 2 is a graph showing a fuel consumption characteristic of an engine of the present invention.
Figure 3:
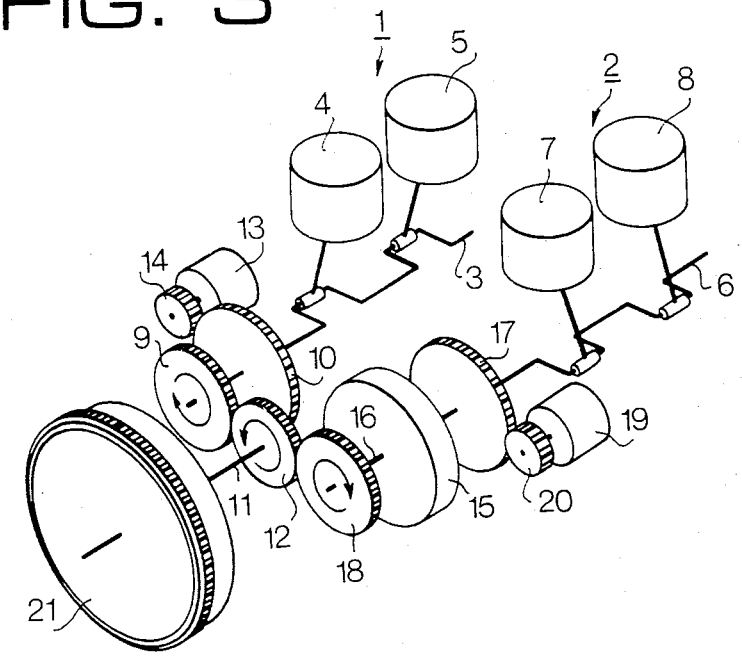
FIG. 3 is a schematic perspective view of an engine assembly according to the present invention.
Figure 6:
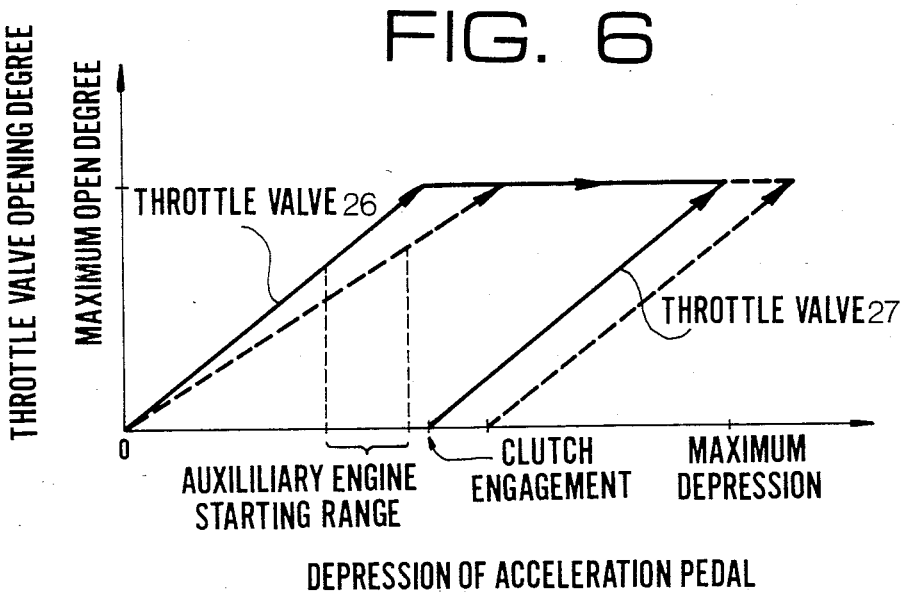
FIG. 6 is a graph showing the relationship between depression of an accelerator pedal and the opening degrees of the throttle valves; and FIGS. *7a, 7b, 7c, 7d* are schematic illustrations showing the operation of the the carburetor assembly.

The present invention will be explained in detail hereinafter with reference to FIGS. 3 to 7. The illustrated engine according to the present invention comprises a primary engine unit 1 of two-cylinder, an auxiliary engine unit 2 of two-cylinder.

Pistons 4 and 5 of the primary engine unit 1 are connected to a crankshaft 3 by connecting rods respectively. On the other hand, pistons 7 and 8 of the auxiliary engine unit 2 are connected to a crankshaft 6 by respective connecting rods. A power transmitting gear 9 and a starting gear 10 are securely mounted on the crankshaft 3, and the gear 9 engages with an output gear 12 secured to an output shaft 11. The starting gear 10 is engaged with a gear 14 of a starter 13. Securely mounted on the crankshaft 6 is a starting gear 17 which is engaged with a gear 20 of a starter 19. The crankshaft 6 is connected to a transmitting shaft 16 through an electromagnetic powder clutch 15. A transmitting gear 18 on the shaft 16 engages with the output gear 12. A flywheel 21 provided with a clutch is operatively mounted on the output shaft 11.

Figure 4:
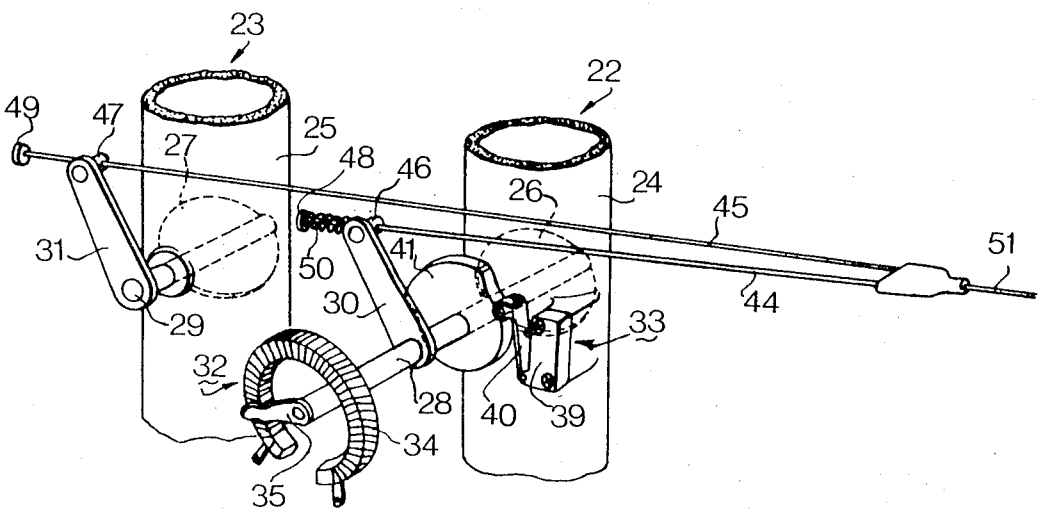
FIG. 4 is a schematic perspective view of a carburetor assembly used for the engine assembly.

Referring to FIG. 4, carburetors 22 and 23 for engine units 1 and 2 respectively comprise parallel barrels 24 and 25, and throttle valve 26 and 27 supported by throttle shafts 28 and 29, respectively. Levers 30 and 31 are secured to the respective throttle shafts 28 and 29 and have pins 46 and 47 each having a hole. A potentiometer 32 for detecting acceleration of the primary engine unit and a throttle position sensor 33 for detecting the timing of joint operation of both engine units are provided in the carburetor 22. The potentiometer 32 comprises a circular resistor 34 and a sliding contact 35 secured to the shaft 28. The throttle position sensor 33 comprises a cam 41 secured to the shaft 28 and a microswitch 39. A cam follower formed as an actuating lever 40 engages with the cam 41.

An accelerator wire 44 passes through the hole in the pin 46 and an accelerator wire 45 passes through the hole in the pin 47. Both wires are connected to a common wire 51 which is connected to an accelerator pedal (not shown). A spring 50 is provided between a stop 48 secured to the end of the wire 44 and the pin 46. A stop 49 is secured to the end of the wire 45.

Figure 5:
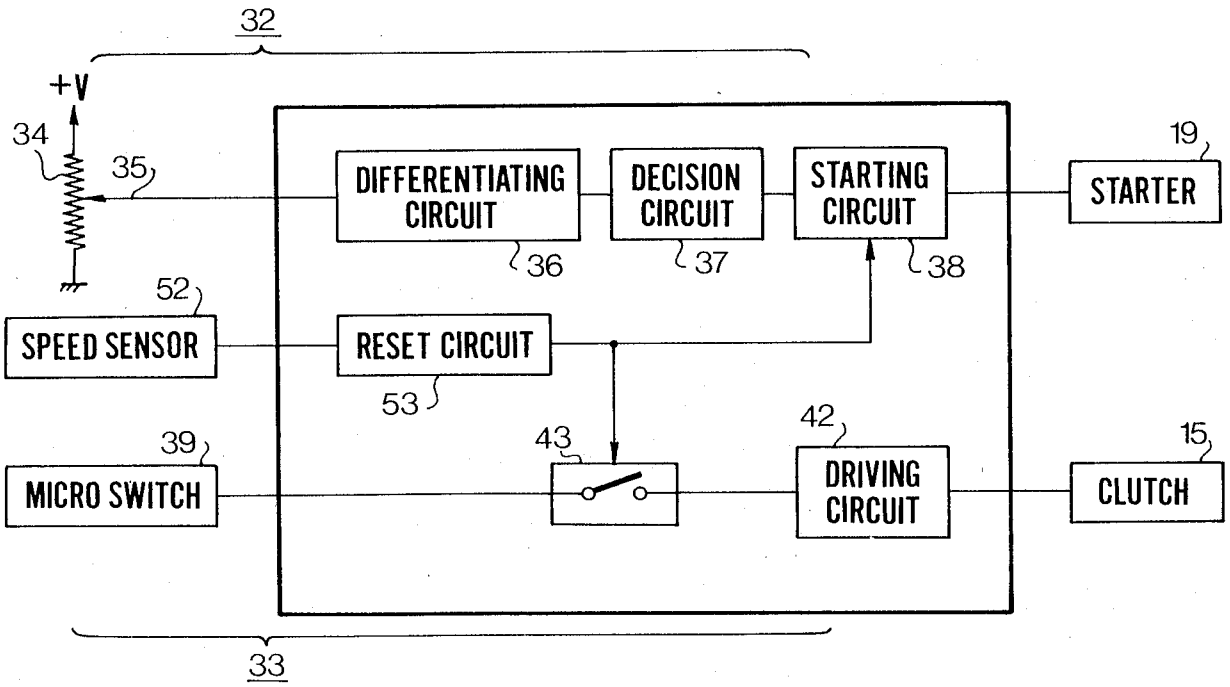
FIG. 5 is a block diagram showing a control system in the engine assembly.
Figure 7A:
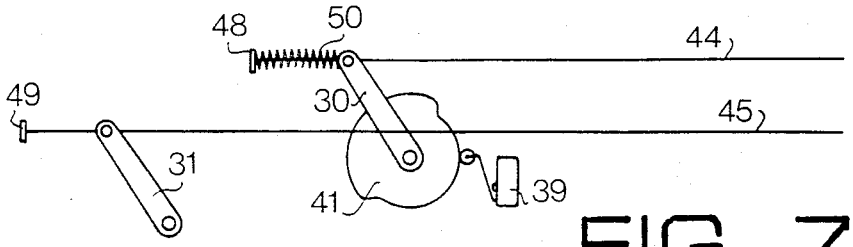
Figure 7B:
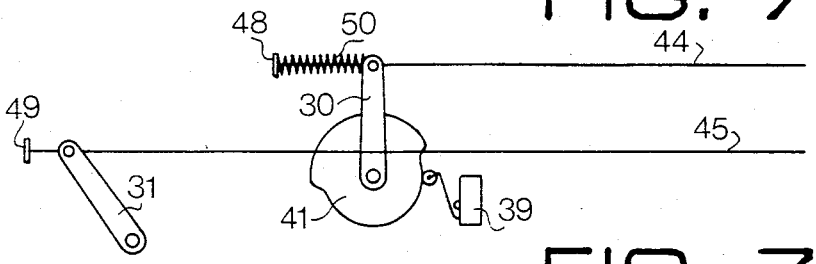
Figure 7C:
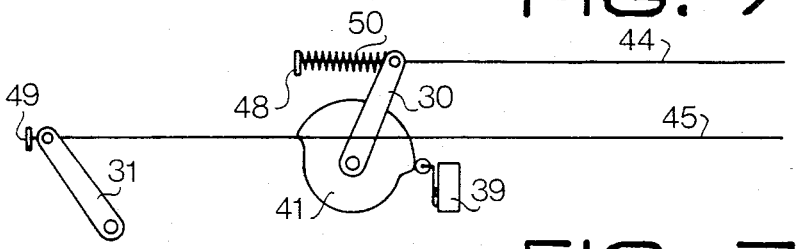
Figure 7D:
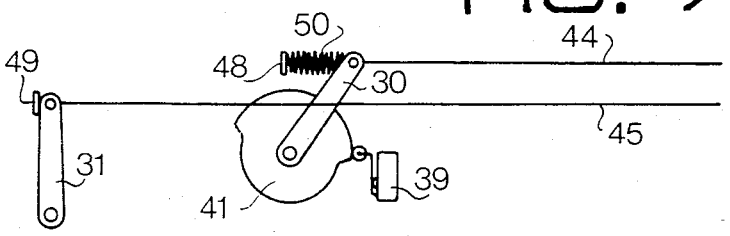

Referring to FIG. 5, the output at the sliding contact 35 of the potentiometer 32 is applied to a differentiating circuit 36, the output of the latter being connected to a starting circuit 38 through a decision circuit 37. The output of the starting circuit 38 is connected to the starter 19 of the auxiliary engine unit 2. On the other hand, the output of the microswitch 39 is connected to a driving circuit 42 through a switch circuit 43 and the output of the driving circuit 42 is connected to the clutch 15 of the auxiliary engine unit 2.

A speed sensor 52 is provided for sensing the operating condition of the auxiliary engine unit 2. The output of the speed sensor 52 is connected to a reset circuit 53, the output of which is connected to the starting circuit 38 and the switch circuit 43. The speed sensor 52 is adapted to produce an output signal, when the engine speed exceeds a predetermined value.

In operation, when the starter 13 is operated, the primary engine unit 1 is started. At that time, since no signal is fed to the driving circuit 42, the clutch 15 is disengaged.

During low engine torque operation, the electromagnetic clutch 15 is disengaged and the fuel consumption characteristic is shown by the first zone C and the running load curve B passes through the minimum fuel consumption zone D. Thus, fuel consumption of the engine is low.

When the accelerator pedal is depressed, the accelerator wires 44 and 45 move to the right in FIG. *7a*. Since the stop 48 engages with the lever 30 through the spring 50 and the stop 49 does not engage with the lever 31, only the primary engine unit 1 is accelerated or decelerated (FIG. *7b*).

In a high engine torque operation, the accelerator pedal is deeply depressed and the output of the potentiometer 32 increases. The output is differentiated by the differentiation circuit 36 and the decision circuit 37 operates to produce an output signal at a proper time dependent on the output of the differentiation circuit 36. The output signal of the decision circuit 37 operates the starting circuit 38, so that the starter 19 is operated. At the same time, an ignition circuit (not shown) is operated. Thus, the auxiliary engine unit 2 is started at a proper time (compare FIG. 6). When the speed of the auxiliary engine unit 2 exceeds a predetermined value, the speed sensor 52 produces an output signal, so that the reset circuit 53 produces an output signal. The output signal of the reset circuit 53 causes the starting circuit 38 to stop the operation of the starter 19. On the other hand, the output signal of the reset circuit 53 closes the contact of the switch circuit 43. Further depression of the accelerator pedal causes the cam 41 to close the microswitch 39 as shown in FIG. *7c*. The output of the microswitch 39 is applied to the driving circuit 42 through the switch circuit 43, so that the clutch 15 is engaged. Thus, the power of the auxiliary engine unit 2 is transmitted to the output shaft 11 through the clutch 15, and the gears 18 and 12. Further depression of the accelerator pedal causes the stop 49 on the accelerator wire 45 to engage the pin 47 on the lever 31 whereby the speed of the auxiliary engine unit 2 is increased upon actuation of the lever 31.

When the accelerator pedal is rapidly depressed for rapid acceleration, the differentiation circuit 36 produces an output signal dependent on the rapid acceleration. Thus, the time for operating the starter 19 is advanced, so that the auxiliary engine unit 2 is started at a proper time dependent on the acceleration.

When the engine speed decreases and microswitch 39 is opened, the clutch 15 is disengaged. Thus, the power of the auxiliary engine unit 2 is cut off. At the same time, the ignition circuit of the auxiliary engine unit is turned off, thereby to stop the operation of the engine unit.

Although the above described engine assembly comprises two engine units, two or more auxiliary engine units may be employed and the starting times of the engine units may be differentiated with respect to each other.

The engine assembly according to the present invention comprises at least one primary engine unit 1 and one auxiliary engine unit 2, the primary engine unit being connected to an output shaft 11 and the auxiliary engine unit being connected to the output shaft through a clutch 15, and further comprises a control system including detecting means 32 for detecting acceleration of the primary engine operation. The control system operates to produce an output signal when the engine torque of the primary engine exceeds a predetermined value at a time dependent on the acceleration of the throttle valve operation for engaging the clutch. Therefore, the auxiliary engine unit is started at a proper time without delay. Thus, the vehicle is driven by the engine assembly at a low fuel consumption in a wide operational range of the engine.

I claim:

1. In an internal combustion engine for motor vehicles, having a primary engine unit, an auxiliary engine unit selectively operating with the primary engine unit, primary and auxiliary carburetors each having a throttle valve for producing an air-fuel mixture to the primary and auxiliary engine units, respectively, and clutch means for selectively connecting the output of the auxiliary engine unit to the output of the primary engine unit, the improvement comprising acceleration sensing means for sensing the magnitude of the acceleration of the primary engine unit and for producing a first output signal dependent on a predetermined magnitude of the acceleration, an auxiliary starter means for starting for said auxiliary engine unit, a starting circuit means for operating said auxiliary starter means in response to said first output signal at a proper time, engine speed sensing means for sensing the engine speed of said auxiliary engine unit and for producing a second output signal at a predetermined engine speed such that said second output signal causes said starting circuit means to stop said auxiliary starter means, throttle position detecting means for producing a third output signal at a predetermined opening degree of the throttle valve of said primary engine unit, a driving circuit means for engaging said clutch means in dependency on said third output signal.

2. The internal combustion engine according to claim 1, further comprising switching means responsive to said second output signal for enabling the subsequent passing of said third output signal to the driving circuit means for engaging said clutch means.

3. The internal combustion engine according to claim 2, wherein said engine speed sensing means include a reset circuit connected to said starting circuit means and to said switching means.

4. The internal combustion engine according to claim 2, further comprising an accelerator pedal of the vehicle, means for operatively connecting said throttle valves to said accelerator pedal, said connecting means turns the throttle valve for the auxiliary engine unit not before said clutch means is engaged upon continued depression of said accelerator pedal.

5. The internal combustion engine according to claim 1, wherein said acceleration sensing means comprises a potentiometer operatively connected to said throttle valve of said primary engine unit and a differentiating circuit means for differentiating the output of the potentiometer.

6. The internal combustion engine according to claim 1, wherein said clutch means is an electromagnetic clutch.

7. The internal combustion engine according to claim 1, wherein said predetermined magnitude is a predetermined opening degree of said throttle valve of said primary engine unit.

8. The internal combustion engine according to claim 1, wherein said engine speed sensing means include a reset circuit connected to said starting circuit means and operatively connected to said driving circuit means.

9. The internal combustion engine according to claim 1, wherein said engine units and said carburetors being arranged such that said predetermined opening degree is reached after occurrence of said predetermined engine speed of said auxiliary engine unit as said throttle valve of said primary engine unit opens.

10. The internal combustion engine according to claim 1, further comprising an accelerator pedal of the vehicle, means for operatively connecting said throttle valves to said accelerator pedal, said connecting means turns the throttle valve for the auxiliary engine unit after said clutch means is engaged upon continued depression of said accelerator pedal.

11. The internal combustion engine according to claim 1, further comprising an accelerator pedal of the vehicle, means for operatively connecting said throttle valves to said accelerator pedal, said connecting means turns the throttle valve for the auxiliary engine unit not before said clutch means is engaged upon continued depression of said accelerator pedal.

12. In an internal combustion engine for motor vehicles, having a primary engine unit, an auxiliary engine unit selectively operating with the primary engine unit, primary and auxiliary carburetors each having a throttle valve for producing an air-fuel mixture to the primary and auxiliary engine units, respectively, and clutch means for selectively connecting the output of the auxiliary engine unit to the output of the primary engine unit, the improvement comprising acceleration sensing means for sensing the magnitude of the acceleration of the primary engine unit and for producing a first output signal dependent on a predetermined magnitude of the acceleration.

an auxiliary starter means for starting for said auxiliary engine unit, a starting circuit means for operating said auxiliary starter means in response to said first output signal, whereby said auxiliary starter means is operated and said auxiliary engine unit is started at a proper time, throttle position detecting means for producing a second output signal at a predetermined opening degree of the throttle valve of said primary engine unit, and a driving circuit means for engaging said clutch means in dependency on said second output signal.

13. The internal combustion engine according to claim 12, further comprising an accelerator pedal of the vehicle, means for operatively connecting said throttle valves to said accelerator pedal, and said connecting means turns the throttle valve for the auxiliary engine unit not before said clutch means is engaged upon continued depression of said accelerator pedal.

14. The internal combustion engine according to claim 13, wherein said connecting means includes, two wires each connected to said accelerator pedal, and wherein said wires are operatively connected to said throttle valves of said primary and auxiliary engine units, respectively.

15. The internal combustion engine according to claim 14, further comprising a spring operatively connected between said throttle valve of said primary engine unit and said wire which is operatively connected to said throttle valve of said primary engine unit.

* * * * *